United States Patent [19]

Hand

[11] 3,954,312

[45] May 4, 1976

[54] WRAP-AROUND SKIRT FOR LOCKER BASKETS

[76] Inventor: William Westley Hand, 324 State Rte. 7 Lot A, Powhatan Point, Ohio 43942

[22] Filed: June 12, 1974

[21] Appl. No.: 478,458

[52] U.S. Cl. ..... 312/213; 312/5; 211/180

[51] Int. Cl.[2] ..... A47B 81/00

[58] Field of Search ..... 312/3, 4, 213; 135/5 B

[56] References Cited

UNITED STATES PATENTS

| | | | |
|---|---|---|---|
| 415,913 | 11/1889 | Kip | 312/5 |
| 548,190 | 10/1895 | Grant | 135/5 B |
| 1,315,497 | 9/1919 | Higdon et al. | 135/5 B |
| 1,408,284 | 2/1922 | Galloway | 135/5 B |
| 1,662,522 | 3/1928 | Laube | 211/180 |
| 1,750,821 | 3/1930 | Snaman | 211/180 |
| 2,004,035 | 6/1935 | Cleveland | 312/5 |
| 2,652,845 | 9/1953 | O'Neill et al. | 135/5 B |
| 3,144,161 | 8/1964 | Glenny | 312/213 |
| 3,460,207 | 8/1969 | Stewart | 24/73 CR |
| 3,522,635 | 8/1970 | Nilsson | 24/73 CR |

FOREIGN PATENTS OR APPLICATIONS

| | | | |
|---|---|---|---|
| 1,490,807 | 8/1966 | France | 135/5 B |

*Primary Examiner*—Casmir A. Nunberg

[57] ABSTRACT

An enclosure suspended from a locker basket, the enclosure serving to separate soiled clothes from clean clothes, the enclosure being comprised of a plyable sheeting material having metal eyelets along its upper edge together with metal rings or hooks for securement to spring hooks attachable to the locker basket, the opposite side edges of the sheeting material being detachably secured together by a similar eyelet and hook structure, and a patch attached to a lower corner of the sheeting material serving to receive a name of a person whose clothes are enclosed by the wrap-around skirt.

2 Claims, 4 Drawing Figures

FIG. 1
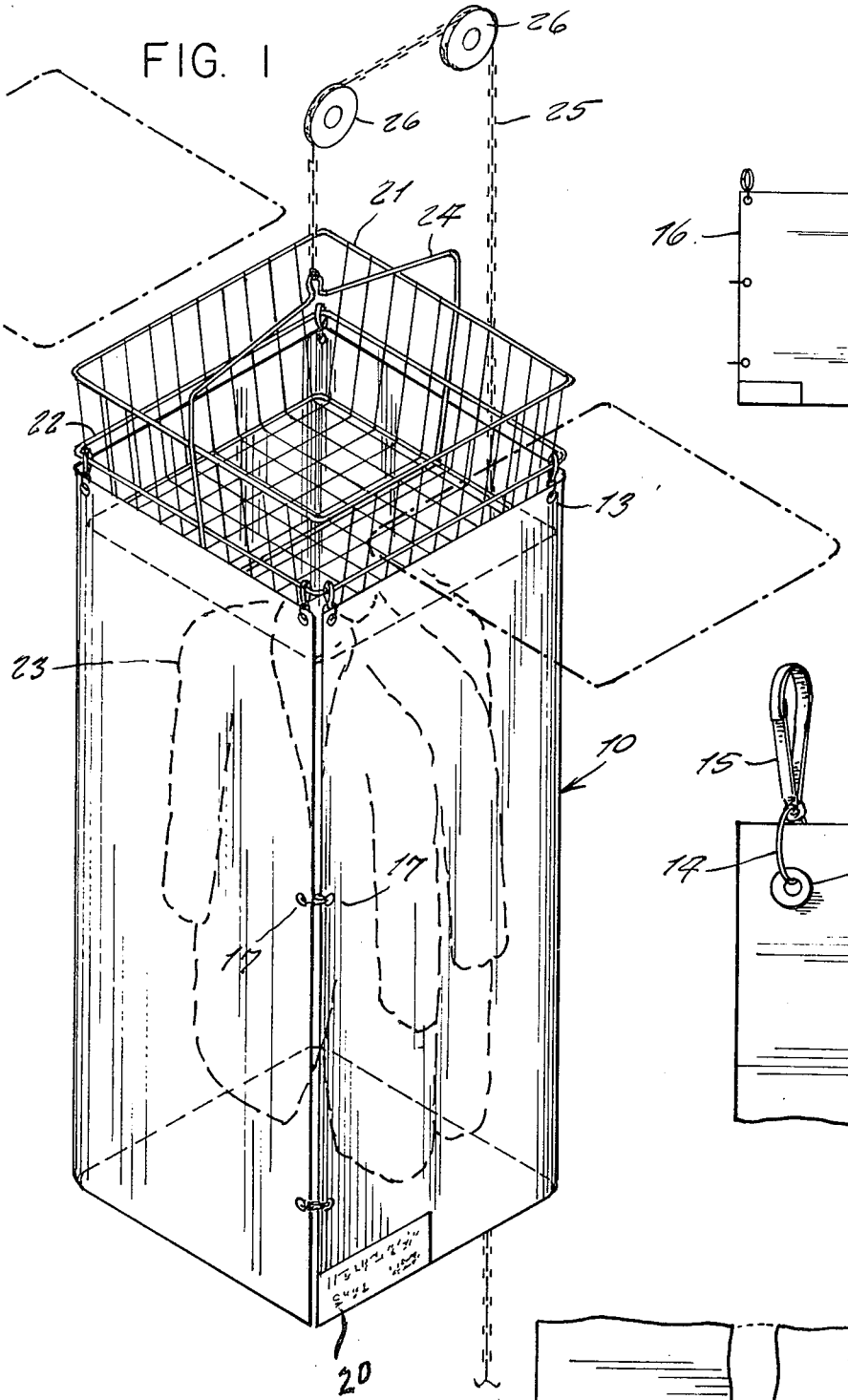
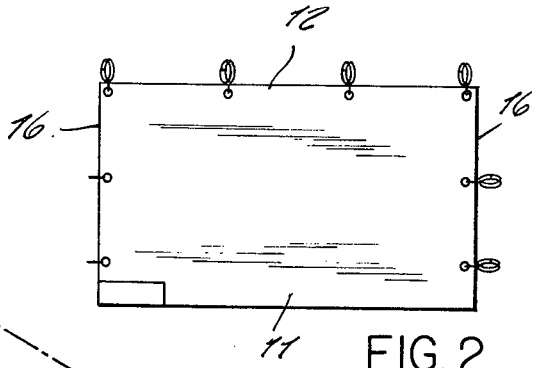
FIG. 2
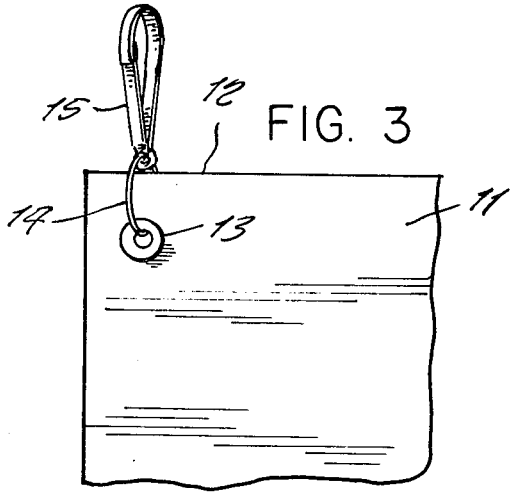
FIG. 3
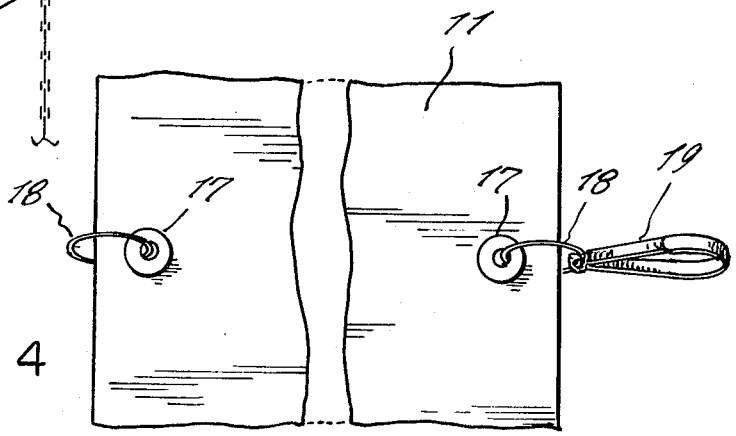
FIG. 4

WRAP-AROUND SKIRT FOR LOCKER BASKETS

This invention relates generally to garment protectors.

It is generally well known to those persons who are employed by coal mines that a great deal of complaint is made by coal miners in the room where they change clothes. They complain that the dirty working clothes on one basket rub occasionally against the clean clothes on an adjacent other basket. This situation certainly must exist in other industries where workmen are obliged to change between working clothes that are dirty and clean clothes in which they go home. This situation is of course objectionable and there fore in want of an improvement.

Accordingly it is a principal object of the present invention to provide a wrap-around skirt for locker baskets which therefore separate the clean clothes from the dirty working clothes.

Another object of the present invention is to provide a wrap-around skirt for locker baskets which encloses a group of clothing around all sides so that they cannot come into contact with clothes that would otherwise rub there against.

Still another object of the present invention is to provide a wrap-around skirt which is suspended from the bottom of a locker basket, and which may be made of a transverse or transparent material so that a working man can readily see there through in order to identify his clothing.

Other objects of the present invention are to provide a wrap-around skirt for locker baskets which is simple in design, inexpensive to manufacture, rugged in construction, easy to use and efficient in operation.

These and other objects will be readily evident upon a study of the following specification and the accompanying drawing, wherein:

FIG. 1 is a perspective view of the present invention shown installed under a locker basket of a clothing change room;

FIG. 2 is a side elevation view of the skirt shown opened out;

FIG. 3 is an enlarged fragmentary detail view of the basket attachment structure;

FIG. 4 is an enlarged fragmentary view of the skirt closure.

Referring now to the drawing in detail, the reference numeral 10 represents a wrap-around skirt for locker baskets according to the present invention, wherein the same is comprised of a large rectangular sheet of any plyable material such as vinyl plastic that may or may not be transparent. The rectangular sheet 11 of plyable material may be approximately five feet in length and approximately three feet six inches high. Along an upper edge 12 thereof there are attached four metal eyelets 13 to each of which a metal ring or hook 14 is secured and to which a spring hook 15 is attached, as shown in FIG. 3 of the drawing. Along opposite side edges 16 of the plyable sheeting 11 there are attached another two metal eyelets 17 to which metal rings or hooks 18 are attached, and the metal rings or hooks along one side edge being additionally attached to spring hooks 19.

At one lower corner of the plyable sheeting there is a patch 20 secured thereto, the patch being of a different colored material and upon which a name of a person may be placed.

As shown in FIG. 1, the wrap-around skirt 10 is suspended beneath a locker basket 21. In securing the wrap-around skirt to the locker basket, the spring hooks 15 snap around a wire rod 22 that extends all around the locker basket, the skirt thus forming a four-sided enclosure. The opposite side edges 16 are thus positioned adjacent each other at one corner of the enclosure, and the spring hook 19 then simply snaps on the metal ring or hook 18 of the other side edge 16, thus securing the skirt so the enclosure does not open up.

Within the enclosure various garments 23 may be enclosed, such garments being suspended from garment hangers that are attached to the underside of the locker basket. The underside of the skirt enclosure is of course left open.

As shown in FIG. 1, the locker basket includes a bale 24 to which one end of a chain 25 is secured, the chain being passed around over head pulleys 26 and the opposite end of the chain extending downwardly so a person can pull the locker basket and wrap around skirt upwardly toward a ceiling of a clothes change room such as is provided in an industrial plant as for example a coal mine.

The wrap around skirt thus separates clean clothes from soiled clothes thereby preventing workmen's complaints.

While various changes may be made in the detail construction, it is understood that such changes will be within the spirit and scope of the present invention as is defined by the appended claims.

What I now claim is:

1. In a wrap-around skirt and locker basket assembly for clothing to be surrounded by other clothing, the combination of a clothes locker basket and a wrap-around skirt depending therefrom, said skirt comprised of a rectangular material being of a length that is equal to a perimeter around a rectangular bottom wall of said locker Basket, said sheeting material being supported at four corners of said locker basket, said sheeting material accordingly forming a rectangular enclosure enclosing clothing suspended below said locker basket so that said clothing does not come into physical contact with other clothing located externally around a side of said rectangular sheeting enclosure wherein the locker basket includes a bail to which there is secured a chain which passes over pulleys so that a person may pull the opposite end of the chain downwardly and pull the basket and the wrap-around skirt upwardly toward a ceiling where it is surrounded by similar locker baskets supporting said other clothing.

2. The combination as set forth in claim 1 wherein an upper edge of said pliable sheeting has a plurality of four metal eyelets secured thereto, each said metal eyelet having a metal ring or hook secured thereto, and each said metal ring or hook having a spring hook secured thereto for engagement to said locker basket and wherein opposite side edges of said pliable sheeting are each provided with an additional pair of metal eyelets each one of which is engaged by a metal ring or hook, and the metal rings or hooks on one said side edge of said pliable sheeting additionally being secured to spring hooks so that said opposite side edges can be secured together.

* * * * *